US006444134B1

(12) United States Patent
Holman et al.

(10) Patent No.: US 6,444,134 B1
(45) Date of Patent: Sep. 3, 2002

(54) WOOD FLOOR REFINISHING PROCESS AND PRODUCT

(75) Inventors: Ronnie Gene Holman, Granite Falls, NC (US); Roy Edward Blackburn, Jr., Oakland; Timothy G. Specht, Berkeley, both of CA (US)

(73) Assignee: The Flecto Company, Inc., Oakland, CA (US)

( * ) Notice: Subject to any disclaimer, the term of this patent is extended or adjusted under 35 U.S.C. 154(b) by 0 days.

(21) Appl. No.: 09/507,953

(22) Filed: Feb. 22, 2000

(51) Int. Cl.[7] ..... B44C 1/22

(52) U.S. Cl. ..... 216/29; 216/83; 134/38; 427/325; 427/339

(58) Field of Search ..... 134/2, 26, 29, 134/38, 42; 216/29, 83; 427/534, 308, 325, 339

(56) References Cited

U.S. PATENT DOCUMENTS 3,547,679 A * 12/1970 Moren ..... 106/284
3,979,219 A * 9/1976 Chang et al. ..... 106/271
4,184,975 A * 1/1980 Krings et al. ..... 252/140
4,269,724 A * 5/1981 Hodson ..... 252/171
4,619,711 A * 10/1986 Olbrueck et al. ..... 134/38
4,643,840 A * 2/1987 Brocklehurst et al. ..... 252/160
4,734,138 A * 3/1988 Ely et al. ..... 134/27
4,737,195 A * 4/1988 Carandang et al. ..... 134/38
5,709,589 A 1/1998 Boone ..... 451/54
5,783,303 A 7/1998 Tsuei ..... 428/354
6,030,466 A * 2/2000 Myers, II ..... 134/38

FOREIGN PATENT DOCUMENTS

JP 59029103 A2 * 2/1984

* cited by examiner

*Primary Examiner*—Anita Alanko
(74) *Attorney, Agent, or Firm*—Fay, Sharpe, Fagan, Minnich & McKee, LLP

(57) ABSTRACT

A method of finishing a wood floor comprising a first step of applying an aqueous polar solvent for a sufficient period of time to allow removal of a portion of any existing stains and soils and to at least partially etch the surface of an existing finish. A second step of applying an aqueous rinse to flush at least a substantial portion of any residue formed in the first steps and a third step of applying a water based finish and allowing it to dry.

16 Claims, No Drawings

WOOD FLOOR REFINISHING PROCESS AND PRODUCT

BACKGROUND OF THE INVENTION

This invention relates to the refinishing of wood floors. More particularly, the invention relates to a product, and a method of its use, for refinishing a wood floor without the need for sanding.

Hardwood floors have been employed in quality housing and offices for more than 150 years. To improve the ability of the surface of the flooring to withstand wear and tear and also to make it attractive in appearance, the raw wood is subjected to smoothing and finishing steps. Nonetheless, over time, even the protected surface of the floor degrades. Accordingly, refinishing of wood floors is a necessary task. Traditionally, refinishing has been considered a relatively messy and time consuming undertaking, often left to the professional.

The process of refinishing has historically included sanding to prepare the surface to accept a new coat. Refinishing then typically involves applying sealants, varnishes, stains, shellacs and waxes to provide the desired appearance. Today, there are machines which will do some of these tasks, for example, sanding machines to drive a belt, circular disc or an oscillating rectangle of sandpaper. Buffing machines are made to provide the same basic motions to a pad of stiff fibers which function to abrade the surface more gently than sandpaper. A typical combination and order of these steps might be i) to hand scrape or rough sand a raw wood floor; ii) to sand by machine with a medium grit sandpaper; iii) to sand by hand with a fine grit sandpaper; iv) to remove all dust; v) to apply a coat of sealant and allow it to dry; vi) to buff the surface; vii) to remove all dust; and viii) to apply a coat of varnish or shellac.

U.S. Pat. No. 5,709,589 teaches a modification to the above procedure wherein the floor is smoothed and cleaned with a rotating buffing pad having a strip of fine grit sandpaper adhered to the buffing pad, followed by buffing without the sandpaper being present, and then cleaning the floor of all dust by vacuuming and by wiping with a dampened rag. Thereafter, a finish comprised of an aqueous dispersion of urethane and acrylic polymers is applied.

Obviously, the sanding requirements of this process are time consuming and messy with respect to the creation of significant quantities of dust. In addition, sanding can be a difficult task for the non-professional floor refinisher. Accordingly, it would be desirable to provide a system for refinishing wood floors which does not require sanding to remove the prior finish.

SUMMARY OF THE INVENTION

The present invention relates to a three component system for refinishing of wood floors. According to one embodiment of the invention, a floor refinishing kit is provided which facilitates the preparation of an old finish for the application of a new finish without the requirement of sanding. The floor refinishing system of the present invention comprises a kit including three floor treatment compositions. A first composition is comprised of an aqueous polar solvent. Preferably, the aqueous polar solvent will have a pH above about 10 and more preferably above about 12. Most preferably, the aqueous polar solvent will include an active ingredient in excess of at least about 2.0% by weight. Particularly preferred active ingredients are alkali metasilicates, orthophosphates, and mixtures thereof. The second component of the kit comprises a residue removal and surface softening formulation, preferably comprised of water and a glycol ether. The third component of the kit comprises the finish, preferably a water based finish including urethane and acrylic polymers or copolymers and a crosslinking agent.

DETAILED DESCRIPTION OF THE INVENTION

While the invention will be described in connection with certain exemplary embodiments, it will be understood that it is not intended to limit the invention to those embodiments. On the contrary, it is intended to cover all alternatives, modifications and equivalents that may be included within the spirit and scope of the invention defined by the appended claims.

The present invention provides a departure from the traditional steps for preparing and refinishing hardwood flooring. Particularly, the present invention is directed to a system including at least three components which does not require sanding to prepare an existing hardwood floor finish. More particularly, the present invention is directed to a chemical system which provides an appropriate treatment of an existing finish to allow the deposition of a new finish. The chemical system (kit) for performing these functions includes a first cleaning agent, a second rinsing and softening agent, and a third finishing agent.

The Cleaning Solution

The cleaning solution of the present invention is an alkaline aqueous solution including an active agent. The cleaning solution has been found to remove stains and soils from the surface of the floor and provide etching of the old finish. Moreover, the existing finish is preferably not totally removed via this process but rather is cleaned and sufficiently etched to facilitate the later chemical bonding (i.e., step 3) of a renewal finish. The active agent is preferably selected from orthophosphates and alkali metasilicates.

Exemplary, alkali metasilicates include sodium or potassium hydroxide, sodium or potassium carbonate, sodium or potassium silicate, sodium gluconate or sodium heptahydrate. Particularly preferred alkali metasilicates include sodium orthosilicate and sodium metasilicate.

Exemplary orthophosphates include sodium hemiphosphate; sodium dihydrogen phosphate monohydrate; sodium dihydrogen phosphate dihydrate; sodium dihydrogen phosphate compound with disodium hydrogen phosphate (MSP-DSP); disodium hydrogen phosphate dihydrate; disodium hydrogen phosphate heptahydrate; disodium hydrogen phosphate octahydrate; disodium hydrogen phosphate dodecahydrate; trisodium phosphate hemihydrate; trisodium phosphate hexahydrate; trisodium phosphate octahydrate; trisodium phosphate dodecahydrate (TSP crystalline); phosphoric acid, postassium salt; potassium dihydrogen phosphate compound with dipotassium hydrogen phosphate monohydrate; monopotassium phosphate (MKP); dipotassium phosphate (DKP); dipotassium hydrogen phosphate trihydrate; dipotassium hydrogen phosphate hexahydrate; tripotassium phosphate; tripotassium phosphate trihydrate; tripotassium phosphate heptahydrate; tripotassium phosphate nonahydrate; calcium hydrogen phosphate; calcium hydrogen phosphate hemihydrate; calcium hydrogen phosphate dihydrate; α-tricalcium phosphate; β-tricalcium phosphate; octacalcium phosphate; hydroxyapatite; fluorapatite; phosphoric acid, calcium salt; calcium salt hydrate; aluminum dihydrogen tripolyphosphate; aluminum phosphate dihydrate (variscite); monoaluminum phosphate sesquihydrate; dialuminum phosphate trihydrate; poly(aluminum metaphosphate); monoiron(III) phosphate; trimagnesium phosphate octahydrate; aluminum hemiphosphate; phosphoric acid, aluminum salt hydrate; aluminum sodium salt; tetrahydrate, iron (III) salt hydrate; triphosphoric acid, monosodium salt, disodium salt, trisodium salt, tetrasodium salt; pentasodium salt; sodium potassium tripolyphosphate; sodium trimetaphosphate; sodium tetrametaphosphate; sodium hexametaphosphate; poly(sodium metaphosphate) (insoluble metaphosphate (IMP)); zirconium phosphate monohydrate; zirconium phosphate dihydtrate; aluminum pyrophosphate; calcium dihydrogen pyrophosphate (calcium acid pyrophosphate); calcium pyrophosphate; potassium trihydrogen pyrophosphate; dipotassium dihydrogen pyrophosphate (potassium acid pyrophosphate); tripotassium hydrogen pyrophosphate; tetrapotassium pyrophosphate; sodium trihydrogen pyrophosphate (monosodium pyrophosphate); disodium dihydrogen pyrophosphate (sodium acid pyrophosphate); disodium dihydrogen pyrophosphate hexahydrate; trisodium hydrogen pyrophosphate (trisodium pyrophosphate); trisodium hydrogen pyrophosphate monohydrate; trisodium hydrogen pyrophosphate nonahydrate; tetrasodium pyrophosphate (TSPP); tetrasodium pyrophosphate decahydrate; silicon pyrophosphate; titanium pyrophosphate. Preferably, a combination of the various cleaning agent compounds will be utilized.

The cleaning solution will preferably contain additional components to accomplish its purpose. For example, a surfactant may be included to facilitate wetting out the cleaning solution on what is often a greasy/oily surface. Similarly, common defoamers and dispersants (to prevent redeposition of soil) may be used. In addition, a chelating agent may be included, such as an ethylenediaminetetra acetic acid, to reduce the tendency for the active cleaning agent to become chemically bound to ionic elements in the water. Furthermore, a surface softening agent may be included, such as ethylene glycol. Finally, a colorant and odorant may be used to improve handling characteristics.

Preferably, the active agent will be present at a level sufficient to raise the pH of the solution in excess of about 10, most preferably in excess of about 12, more preferably in excess of about 13. For example, the active agent may comprise from about 1% to about 10% of the cleaning solution with water comprising from about 99% to about 50%. The surfactant and surface softening agent may each comprise up to 20% by weight, preferably less than about 10%. The remaining ingredients are individually generally less than about 5% by weight. Interestingly, the cleaning agent is of a type which is commercially available as Liquid Wall Cleaner from Chemspec.

The Rinse Solution

The rinse solution of the refinishing kit is directed to a solution comprised primarily water, but may also include a suitable agent for softening of the existing etched finish. Preferably, the surface softening agent will be a glycol ether. In that embodiment, the rinse solution will be comprised of from 30 to 70% water and from 30 to 70% softening agent.

The Finish Component

The water-based coating composition preferably includes urethanelacrylic copolymers. Preferably, the curable water-based coating compositions of the present invention do not contain an undesirable amount of VOCs, more preferably, they contain less than about 5 wt. %, and preferably less than about 2 wt. % VOCs based on the total weight of the composition (including water).

Preferably, the curable coating compositions of the present invention have a solids content of about 30–70 wt. %, more preferably about 35–65 wt. % based on the total weight of the composition (including the water). With a solids content of less than about 30 wt. %, the curable coating composition is generally too thin for most applications to form a useful cured coating, although it may be used in applications that require thin coatings. With a solids content of more than about 70 wt. %, the curable coating composition is generally too viscous to coat easily.

The curable water-based coating compositions of the present invention will preferably include urethane/acrylic polymers or copolymers, coalescing aid and an alkaline-stable crosslinker. Optional additives include, for example, a thickener and a surfactant.

The "principal polymers" are those that are capable of crosslinking (e.g. urethane/acrylic copolymers, aliphatic urethanes, acrylic copolymers, and other polymers containing pendant carboxylic acid groups). Suitable polymers of urethane and acrylic and urethane/acrylic copolymers (i.e., a polymer containing urethane (—$R^1$NHC(O)O$R^2$—) and acrylic—$R^3$—C(O)OH moieties) for use in the compositions of the present invention are those are that are capable of forming stable dispersions in water. One specific example of a nonfilm-forming urethane/acrylic copolymer is a high solids, monomer-free, radiation-curable, water-borne urethane/acrylic copolymer, which is commercially available under the trade designation "NeoRad 3709" from NeoResins, a division of Avecia, Wilmington, Mass. Specific examples of urethane and acrylic polymers include NEOREZ R9699 and NEOCRYL XA6092. These urethane/acrylic polymers and copolymers are designed for high performance uses, where hardness, flexibility, UV resistance, chemical resistance, and abrasion resistance are desired.

The curable water-based coating compositions of the present invention may use a glycol ether as a coalescing aid for the nonfilm-forming urethane/acrylic polymers or copolymers. This coalescing aid not only enhances film formation but contributes to the flexibility of the coating. Suitable glycol ether coalescing aids are commercially available from The Dow Chemical Company, Midland, Mich., under the trade designation Dowanol. These coalescing aids typically also function as wetting agents in the compositions of the present invention.

The coalescing aid, or a mixture of coalescing aids, is present in the curable coating compositions of the present invention in an amount effective to meld the urethane/acrylic particles during the drydown or curing stage and thereby allow a continuous film to form. Preferably, coalescing aid, or a mixture of such coalescing aids, is present in the curable coating compositions of the present invention in an amount of no greater than about 15 wt. %, based on the weight of polymer solids. More preferably, the curable coating compositions include about 1–10 wt. %, most preferably, about 3–8 wt. %, coalescing aid, based on the weight of polymer solids.

A crosslinker is included in the curable coating compositions of the present invention to enhance the tensile strength of the present invention to enhance the tensile strength of the cured coating and improve its chemical resistance, for example. Suitable crosslinkers are those that can be used to crosslink urethane/acrylic polymers or copolymers, and are stable in aqueous alkaline solutions. Examples of such crosslinkers include, but are not limited to, epoxy silanes, amino silanes and aziridine derivatives.

Suitable epoxy silanes include Z-6040 available from Dow Corning. Suitable aminosilanes include Z 6020 available from Dow Corning. Suitable polyfunctional aziridines are those commercially available under the trade designations "XAMA-2" (trimethylolpropane-tris-(β-(N-aziridinyl) propionate) and "XAMA-7" (penaerythritol-tris-(β-N-aziridinyl) propionate) from B.F. Goodrich Chemical Co., Cleveland, Ohio and "NeoCryl CX-100" from Zeneca Resins, Wilmington, Mass. These crosslinkers are particularly desirable because they also function as adhesion promoters to materials such as polyester, glass, etc. They are preferably used with polymers containing active hydrogens such as the urethane/acrylic copolymers described above that contains pendant carboxylic acid groups.

The alkaline-stable crosslinker, or mixture of alkaline-stable crosslinkers, is present in the curable coating compositions of the present invention in an amount effective to provide a durable cured coating. Preferably, the alkaline-stable crosslinker is present in the curable coating compositions of the present invention in an amount of 0.1–10 wt. % and more preferably about 0.5–6 wt. % based on the weight of polymer solids.

A thickener may be used in the curable coating compositions of the present invention to increase the viscosity of the dispersions. This is sometimes important to provide coatings that do not sag. Suitable thickeners are those that are compatible with urethane/acrylic dispersions. As used herein "compatible" means that the component does not cause adverse effects to the curable compositions (e.g. precipitation, flocculation, or other separation of the components), or to the cured coating (e.g. disruption of film continuity, phase separation, or loss of adhesion to the backing). Preferred thickeners for use in the curable coating compositions of the present invention are associative thickeners. An "associative" thickener is a polymeric compound having hydrophobic groups that associate with the dispersed polymer particles of the curable coating composition. This association is believed to result in adsorption of the thickener molecule onto the dispersed polymer particles.

A preferred thickener is a polyurethane available under the trade designation "DSX-1514" from Henkel Corp., Kankakee, Ill., is an aqueous dispersion having 40 wt. % solids. It is a high shear and low molecular weight thickener having a Brookfield viscosity of 3000 centipoise at 25° C. It is particularly desirable because it provides a significant increase in viscosity of the coating composition when used in small amounts. An associative thickener, or mixture associative thickeners, may also be present in the curable coating compositions of the present invention in an amount effective to increase the viscosity of the dispersions to provide coatings that do not sag.

Surfactants may be used in the curable coating compositions of the present invention to reduce foaming and to enhance leveling and wetting. This is important to provide smooth, uniform coatings. A wide variety of surfactants, i.e., surface-active agents, are suitable for use in the curable coating compositions of the present invention.

Suitable surfactants include, but are not limited to, flow control agents, wetting agents, dispersants, adhesion enhancers, defoamers, etc. Preferred surfactants are nonionic or anionic. Examples of preferred surfactants are available under the trade designation "Silwet L-7210" (a nonionic polyalkeneoxide modified polydimethylsiloxane) from Osi Specialties, In., Danbury, Conn., "Surfynol 104PA" (2,4,7,9-tetramethyl-5-decyn-4,7-diol) from Air Products and Chemicals, Inc., Allentown, Pa. and "Triton GR-7M" (an anionic sulfosuccinate) from Union Carbide Chemicals and Plastics Company, Inc., Danbury, Conn.

A surfactant, or mixture of surfactants, is present in the curable coating compositions of the present invention in an amount effective to provide a smooth, uniform coating. Preferably, a surfactant, or mixture of surfactants, is present in the curable coating compositions of the present invention in an amount of about 0.1–3 wt. % and more preferably, about 0.5–2 wt. %, based on the total weight of the curable coating composition (including water).

Additional additives that are suitable for use in water-based systems are those that perform the functions of zinc complexes, ammonia, defoamer, leveling agent, and/or wetting agent, for example, are also suitable.

Exemplary finish compositions suitable for the present kit are sold as Pacific Strong and Basic 1 or Impact available from Bona Kemi, Basic Coating, respectively.

Method of Application

First, the cleaning solution is deposited on the floor finish to be refinished using, for example, squeeze or mister bottle, damp mop, brush or roller techniques. The finish can then be lightly scrubbed with an abrading brush or pad. Thereafter, the cleaning solution is removed with a mop or towels. Next, the rinsing agent is deposited via, for example, roller, brush, squeeze or mister bottle, or mop. The rinsing agent is also scrubbed with a brush or pad and then removed again utilizing roller, pads, towels, or mop, etc. Subsequent to drying, the finish can be applied according to any technique known to those skilled in the art such as lambs wool or other short nap pad or brush, etc. Preferably, multiple coats of the finish will be applied, (i.e. 2 to 5) to effect sufficient thickness and durability.

Thus, it is apparent that there has been provided in accordance with the invention, a method and kit for refinishing floors that fully satisfies the objects, aims and advantages set forth above. While the invention has been described in conjunction with the specific embodiments thereof it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method of finishing a wood floor comprising:

in a first step applying an alkaline aqueous solvent to a wood floor including an existing finish to be resurfaced and exposing said wood floor to the solvent for a sufficient period of time to allow substantial removal of any existing stain and soil and to at least partially etch the surface of said existing finish;

in a second step applying an aqueous rinse comprised of water and a softening agent to flush at least a substantial portion of any residue formed in the first step and soften said existing etched finish; and in a third step applying a water based finish and allowing it to dry.

2. The method of claim 1 wherein said aqueous solvent has a pH above about 10.

3. The method of claim 2 wherein said aqueous solvent has a pH above about 12.

4. The method of claim 1 wherein said third step is repeated multiple times to increase finish thickness and durability.

5. The method of claim 1 wherein said aqueous solvent includes an active ingredient selected from the group consisting of alkali metasilicates, orthophosphates and mixtures thereof.

6. The method of claim 5 wherein said active ingredient is selected from the group consisting of sodium orthosilicate, sodium metasilicate, trisodium phosphate and mixtures thereof.

7. The method of claim 5 wherein said active ingredient comprises at least 2.0% by weight of said aqueous solvent.

8. The method of claim 1 wherein said aqueous solvent further includes a chelating agent.

9. The method of claim 8 wherein said chelating agent comprises EDTA.

10. The method of claim 1 wherein said aqueous solvent further comprises a surfactant.

11. The method of claim 1 wherein said aqueous solvent further comprises a colorant.

12. The method of claim 1 wherein said softening agent comprises glycol ether.

13. The method of claim 1 wherein said finish comprises a water based urethane and/or acrylic resin dispersion.

14. The method of claim 13 wherein said finish comprises both urethane and acrylic resins.

15. The method of claim 1 wherein said first step further includes scrubbing the surface of said wood floor.

16. The method of claim 1 wherein sanding of said wood floor is not performed.

* * * * *